US011319712B2

(12) United States Patent
Hannig

(10) Patent No.: US 11,319,712 B2
(45) Date of Patent: May 3, 2022

(54) PANEL WITH A HOOK-FORM LOCKING SYSTEM

(71) Applicant: I4F Licensing NV, Hamont-Achel (BE)

(72) Inventor: Hans-Jürgen Hannig, Bergisch Gladbach (DE)

(73) Assignee: I4F Licensing NV, Hamont-Achel (BE)

( * ) Notice: Subject to any disclaimer, the term of this patent is extended or adjusted under 35 U.S.C. 154(b) by 0 days.

(21) Appl. No.: 16/940,546

(22) Filed: Jul. 28, 2020

(65) Prior Publication Data

US 2020/0354970 A1 Nov. 12, 2020

Related U.S. Application Data

(63) Continuation of application No. 15/533,811, filed as application No. PCT/EP2015/078854 on Dec. 7, 2015, now Pat. No. 10,738,477.

(30) Foreign Application Priority Data

Dec. 8, 2014 (EP) ..... 14196822

(51) Int. Cl.

| | |
|---|---|
| ***E04F 15/02*** | (2006.01) |
| ***E04F 15/04*** | (2006.01) |
| ***E04F 15/10*** | (2006.01) |

(52) U.S. Cl.

CPC ..... *E04F 15/02038* (2013.01); *E04F 15/04* (2013.01); *E04F 15/105* (2013.01); *E04F 2201/0146* (2013.01); *E04F 2201/0161* (2013.01); *E04F 2201/023* (2013.01); *E04F 2201/027* (2013.01); *E04F 2201/043* (2013.01)

(58) Field of Classification Search

CPC ..... E04F 15/02; E04F 2201/0138; E04F 15/02038; E04F 2201/0146; E04F 2201/0153

See application file for complete search history.

(56) References Cited

U.S. PATENT DOCUMENTS

| | | | |
|---|---|---|---|
| 3,921,312 | A | 11/1975 | Fuller |
| 4,426,820 | A | 1/1984 | Terbrack et al. |
| 4,696,132 | A | 9/1987 | LeBlanc |
| 5,182,892 | A | 2/1993 | Chase |
| 5,274,979 | A | 1/1994 | Tsai |
| 6,006,486 | A | 12/1999 | Moriau et al. |
| 6,098,365 | A | 8/2000 | Martin et al. |

(Continued)

FOREIGN PATENT DOCUMENTS

| | | | |
|---|---|---|---|
| CA | 2363184 | A1 | 7/2001 |
| CN | 2361725 | Y | 2/2000 |

(Continued)

*Primary Examiner* — Brian E Glessner
*Assistant Examiner* — Daniel J Kenny
(74) *Attorney, Agent, or Firm* — The Webb Law Firm

(57) ABSTRACT

A panel including a panel top side and a panel underside and including at least four panel margins which are situated opposite one another in pairwise fashion, having complementary holding profiles which are provided in pairwise fashion on the panel margins and which fit together such that identical panels are fastenable to one another, wherein at least one of the holding profile pairs is equipped with hook profiles, specifically with a receiving hook on one panel margin and with an arresting hook on the opposite panel margin.

8 Claims, 5 Drawing Sheets

(56) References Cited

U.S. PATENT DOCUMENTS

| | | | | |
|---|---|---|---|---|
| 6,131,355 | A | 10/2000 | Groh et al. | |
| 6,490,836 | B1 | 12/2002 | Moriau et al. | |
| 6,505,452 | B1 | 1/2003 | Hannig et al. | |
| 6,591,568 | B1 | 7/2003 | Palsson | |
| 6,766,622 | B1 | 7/2004 | Thiers | |
| 6,769,219 | B2 | 8/2004 | Schwitte et al. | |
| 6,874,292 | B2 | 4/2005 | Moriau et al. | |
| 6,880,307 | B2 | 4/2005 | Schwitte et al. | |
| 6,928,779 | B2 | 8/2005 | Moriau et al. | |
| 6,955,020 | B2 | 10/2005 | Moriau et al. | |
| 7,121,058 | B2 | 10/2006 | Palsson et al. | |
| 7,398,625 | B2 | 7/2008 | Pervan | |
| 7,617,651 | B2 | 11/2009 | Grafenauer | |
| 7,654,054 | B2 | 2/2010 | Moriau et al. | |
| 7,712,280 | B2 | 5/2010 | Moriau et al. | |
| 7,757,453 | B2 | 7/2010 | Moriau et al. | |
| 7,810,297 | B2 | 10/2010 | Moriau et al. | |
| 7,874,119 | B2 | 1/2011 | Pervan et al. | |
| 7,958,689 | B2 | 6/2011 | Lei | |
| 7,980,043 | B2 | 7/2011 | Moebus | |
| 8,091,238 | B2 | 1/2012 | Hannig | |
| 8,191,333 | B2 * | 6/2012 | Braun | E04G 23/006 52/745.19 |
| 8,215,076 | B2 | 7/2012 | Pervan et al. | |
| 8,281,549 | B2 | 10/2012 | Du | |
| 8,365,499 | B2 | 2/2013 | Nilsson et al. | |
| 8,375,672 | B2 * | 2/2013 | Hannig | E04F 15/02038 52/588.1 |
| 8,689,512 | B2 | 4/2014 | Pervan | |
| 8,745,952 | B2 | 6/2014 | Perra et al. | |
| 8,756,899 | B2 | 6/2014 | Nilsson et al. | |
| 8,789,334 | B2 | 7/2014 | Moriau et al. | |
| 8,978,336 | B2 | 3/2015 | Perra et al. | |
| 9,217,250 | B2 | 12/2015 | Perra et al. | |
| 9,428,919 | B2 | 8/2016 | Pervan et al. | |
| 9,695,851 | B2 | 7/2017 | Hannig | |
| 2003/0093964 | A1 | 5/2003 | Bushey et al. | |
| 2004/0177584 | A1 | 9/2004 | Pervan | |
| 2005/0028474 | A1 | 2/2005 | Kim | |
| 2005/0171246 | A1 | 8/2005 | Maine et al. | |
| 2005/0183370 | A1 | 8/2005 | Cripps | |
| 2006/0156666 | A1 | 7/2006 | Caufield | |
| 2006/0260253 | A1 | 11/2006 | Brice | |
| 2007/0130872 | A1 | 6/2007 | Goodwin et al. | |
| 2008/0034701 | A1 | 2/2008 | Pervan | |
| 2009/0019808 | A1 | 1/2009 | Palsson et al. | |
| 2009/0126308 | A1 | 5/2009 | Hannig et al. | |
| 2009/0249733 | A1 | 10/2009 | Moebus | |
| 2011/0056167 | A1 | 3/2011 | Nilsson | |
| 2011/0131909 | A1 | 6/2011 | Hannig | |
| 2011/0138722 | A1 | 6/2011 | Hannig | |
| 2013/0309441 | A1 | 11/2013 | Hannig | |
| 2014/0150369 | A1 | 6/2014 | Hannig | |
| 2014/0165493 | A1 | 6/2014 | Palsson et al. | |
| 2014/0283477 | A1 | 9/2014 | Hannig | |
| 2016/0186443 | A1 | 6/2016 | Perra et al. | |
| 2017/0241136 | A1 | 8/2017 | Kell | |

FOREIGN PATENT DOCUMENTS

| | | | |
|---|---|---|---|
| DE | 19933343 | A1 | 2/2001 |
| DE | 202005004537 | U1 | 7/2005 |
| DE | 102005028072 | A1 | 12/2006 |
| DE | 102006011887 | A1 | 7/2007 |
| DE | 202008011589 | U1 | 1/2009 |
| DE | 102011086846 | A1 | 8/2012 |
| EP | 0214643 | A2 | 3/1987 |
| EP | 1243721 | A2 | 9/2002 |
| EP | 1518032 | A1 | 3/2005 |
| EP | 1585875 | B1 | 10/2005 |
| FR | 2416988 | A1 | 9/1979 |
| FR | 2746127 | A1 | 9/1997 |
| FR | 2826391 | A1 | 12/2002 |
| GB | 816243 | | 7/1959 |
| GB | 2216976 | A | 10/1989 |
| JP | 170939 | U | 5/1989 |
| JP | 324538 | U | 3/1991 |
| JP | H06117081 | A | 4/1994 |
| JP | 7300979 | A | 11/1995 |
| JP | H08270193 | A | 10/1996 |
| JP | H1144084 | A | 2/1999 |
| WO | 0063510 | | 10/2000 |
| WO | 0175247 | A1 | 10/2001 |
| WO | 0188306 | A1 | 11/2001 |
| WO | 03016654 | A1 | 2/2003 |
| WO | 2006133690 | A1 | 12/2006 |
| WO | 2007118352 | A1 | 10/2007 |
| WO | 2012084604 | A1 | 6/2012 |

* cited by examiner

PANEL WITH A HOOK-FORM LOCKING SYSTEM

CROSS REFERENCE TO RELATED APPLICATIONS

This application is a continuation application of U.S. patent application Ser. No. 15/533,811, filed Dec. 7, 2015, which is the United States national phase of International Application No. PCT/EP2015/078854 filed Dec. 7, 2015, and claims priority to European Patent Application No. 14196822 filed Dec. 8, 2014, the disclosures of which are hereby incorporated in their entirety by reference.

BACKGROUND OF THE INVENTION

Field of the Invention

The invention relates to a panel comprising a panel top side and a panel underside and comprising at least four panel margins which are situated opposite one another in pairwise fashion, having complementary holding profiles which are provided in pairwise fashion on the panel margins and which fit together such that identical panels are fastenable to one another, wherein at least one of the holding profile pairs is equipped with hook profiles, specifically with a receiving hook on one panel margin and with an arresting hook on the opposite panel margin.

Description of Related Art

Such panels are used, for example, for producing floor coverings, and in particular, such panels are suitable for floor coverings installed in floating fashion. The panels normally have decorative surfaces.

SUMMARY OF THE INVENTION

The proposed panel is intended to be suitable for locking in accordance with the "fold-down method". For said method, a panel type is utilized in which one of the holding profile pairs is equipped with a modified tongue-and-groove profile, whereas the other holding profile pair is equipped with the hook profiles according to the invention. For the fold-down method, a new panel is set at an angle and is preferably placed with its tongue profile margin against the groove profile margin of a laid panel or of a panel row. Subsequently, the new panel is pivoted down into the plane of the installed panels, and the tongue profile is thereby locked in form-fitting fashion to the groove profile. During the said downward pivoting movement, it is also the case at the same time that form-fitting locking of the hook profiles is generated, because one of the hook profiles moves toward the other hook profile with a scissor-like movement and is hooked together with said other hook profile in form-fitting fashion. Here, locking occurs.

The proposed hook profiles are however furthermore also suitable for a push-down locking arrangement. For a push-down locking arrangement, all holding profile pairs of a panel must be capable of being connected by means of a vertical movement, that is to say for example by means of a lowering movement of a panel, specifically in a direction perpendicular to the panel top side (vertically). The fold-down method then cannot be used.

In practice, situations arise in which a panel at the end of a panel row cannot be locked because a wall is in the way and the panel is too long. In order that the gap in the floor can be closed, it is customary for a panel to be severed, for example using a saw, in order to shorten it to the required length. The severed-off remaining piece of the panel can generally be used to commence a new panel row. It is basically the case that the complementary holding profiles of a severed panel always fit into one another. In principle, it is thus possible for complementary holding profile margins of a severed panel to be locked to one another.

WO 01/02670 proposes different hook profile pairs. The hook profiles are intended to prevent the panels from being pulled apart horizontally, that is to say in the panel plane and perpendicular to the locked panel margins. It has however been found that the strength of the hook profiles is unsatisfactory under the action of load in said horizontal direction.

Further panels with hook profile pairs are known from WO 2010/143962 A1. The various exemplary embodiments of said prior art suffer from the fact that the hook profile pairs can rupture if pulled apart in the panel plane and perpendicular to the locked panel margins. This occurs in particular if the panels are composed of artificial wood material composed of wood particles or fibers bonded to form a board material using a bonding agent.

The applicant therefore seeks to realize a panel with an improved hook profile pair.

For this purpose, the invention proposes a panel comprising a panel top side and a panel underside and comprising at least four panel margins which are situated opposite one another in pairwise fashion, having complementary holding profiles which are provided in pairwise fashion on the panel margins and which fit together such that identical panels are fastenable to one another, wherein at least one of the holding profile pairs is equipped with hook profiles, specifically with a receiving hook on one panel margin and with an arresting hook on the opposite panel margin, wherein the receiving hook has a receiving edge directed toward the panel top side and a receiving groove open toward the panel top side, and the arresting hook is equipped with an arresting edge which is directed toward the panel underside and with an arresting groove which is open toward the panel underside, wherein the receiving edge has an inner side which faces toward the receiving groove, and said inner side serves as lower locking surface, and in a manner adapted to this, the arresting edge has an inner side which faces toward the arresting groove, and said inner side serves as corresponding upper locking surface, with the condition that both the upper locking surface and the lower locking surface are each inclined relative to the perpendicular to the panel top side such that, in the locked state, said lower locking surface and upper locking surface are oriented parallel to one another and can make contact, wherein the inclination of the locking surfaces is selected such that the normal vector with respect to the lower locking surface intersects the panel top side and the normal vector with respect to the upper locking surface intersects the panel underside, wherein a lower detent engagement point is provided which comprises a first detent means which is arranged on an outer side of the receiving edge, and the lower detent engagement point comprises a second detent means which corresponds to said first detent means and which is arranged on a recessed groove flank of the arresting groove, wherein at least a partial section of the top side of the receiving edge runs downward in an inclined manner in the direction of the outer side of the receiving edge, wherein at least a partial section of the groove base of the arresting groove is adapted in complementary fashion to the inclination of the top side of the receiving edge.

In the context of the invention, the normal vector is directed in each case perpendicularly outward from the corresponding locking surface (not directed into the panel material). With the respective panel side that it intersects, the normal vector encloses in each case an angle which is equal to the angular dimension by which the locking surfaces are inclined relative to the perpendicular to the panel top side (alternate angle). The inclination of the locking surfaces relative to the perpendicular to the panel top side may lie in an angle range a from 4° to 50°. The angle α lies preferably in a range from 5° to 30°, and particularly preferably in a range from 5° to 15°.

The panel is preferably formed from a wood material such as HDF, MDF or OSB, wherein, in the broader sense, these may also include WPC (wood plastic composite) materials. Since the locking mechanism necessitates a certain degree of elasticity, in particular in the region of the first detent means and of the second detent means corresponding to said first detent means, the stated materials are suitable owing to their certain degree of elasticity. Alternatively, the panel material may also be a plastic, such as for example in the case of LVT (luxury vinyl tiles) products, because said plastic likewise exhibits a certain degree of elasticity.

If the main body of the panel is composed at least partially of a plastic, then one refinement may be composed of a main body made from a plastic or from a wood plastic composite (WPC) material. The carrier board or the main body is formed for example from a thermoplastic, elastomer or thermosetting plastic. Recycled materials made from the stated materials may also be used within the context of the invention. Here, use is preferably made of board materials, composed in particular of thermoplastic material, such as polyvinyl chloride, polyolefins (for example polyethylene (PE), polypropylene (PP), polyamides (PA), polyurethanes (PU), polystyrene (PS), acrylonitrile butadiene styrene (ABS), polymethyl methacrylate (PMMA), polycarbonate (PC), polyethylene terephthalate (PET), polyether ether ketone (PEEK), or mixtures or copolymers. Here, regardless of the main material of the carrier board, it is for example possible for plasticizers to be provided which may be present approximately in a range from ≥0 wt. % to ≤20 wt. %, in particular ≤10 wt. %, preferably ≤7 wt. %, for example in a range from ≥5 wt. % to ≤10 wt. %. A suitable plasticizer comprises for example the plasticizer known under the trade name "Dinsch" from BASF. Furthermore, as a substitute for conventional plasticizers, use may be made of copolymers, such as for example acrylates or methacrylates.

Thermoplastic materials in particular also offer the advantage that the products produced therefrom can be very easily recycled. Use may also be made of recycled materials from other sources. This yields a further possibility for lowering production costs.

Such carrier boards are in this case of highly elastic or resilient form, permitting a comfortable impression when they are stepped on and furthermore permitting a reduction of the noises that arise when they are stepped on in relation to conventional materials, and thus improved footstep sound deadening can be realized.

Furthermore, the abovementioned carrier boards offer the advantage of good water resistance, because they exhibit swelling of 1% or less. This surprisingly applies not only to pure plastics carriers but also to WPC materials, as will be discussed in detail below.

The material of the carrier board may particularly advantageously have or be composed of wood polymer materials (wood plastic composite, WPC). Here, for example, a wood and a polymer may be suitable which may be present in a ratio of 40/60 to 70/30, for example 50/50. As polymer constituents, use may be made for example of polypropylene, polyethylene or a copolymer made from the two aforementioned materials. Such materials offer the advantage that they can be formed into a carrier board in the above-described method even at low temperatures, for example in a range from ≥180° C. to ≤200° C., such that particularly effective process management, for example with exemplary line speeds in the region of 6 m/min, can be made possible. For example, for a WPC product with a 50/50 distribution of the wood and polymer fractions in the case of an exemplary product thickness of 4.1 mm, are possible, which can permit a particularly effective production process.

Furthermore, it is thus possible to produce very stable panels which furthermore exhibit high elasticity, which may be advantageous in particular for an effective and inexpensive formation of connecting elements on the edge region of the carrier board and furthermore with regard to footstep sound deadening. Furthermore, the abovementioned good water compatibility with swelling of less than 1% can also be made possible with such WPC materials. Here, WPC materials may for example have stabilizers and/or other additives which may preferably be present in the plastics fraction.

Furthermore, it may be particularly advantageous if the carrier board comprises or is composed of a PVC-based material. Such materials can also be used particularly advantageously for high-grade panels which can even be used without problems in wet rooms, for example. Furthermore, PVC-based materials for the carrier board are also expedient for a particularly effective production process, because here, approximate line speeds of 8 m/min in the case of an exemplary product thickness of 4.1 mm may be possible, which can permit a particularly effective production process. Furthermore, such carrier boards also exhibit advantageous elasticity and water compatibility, which can lead to the abovementioned advantages.

Here, mineral filler materials can be advantageous in plastics-based panels such as inter alia in the case of WPC-based panels. Particularly suitable materials here are for example talk or calcium carbonate (chalk), aluminum oxide, silica gel, quartz powder, wood powder, gypsum. For example, chalk may be provided in a range from ≥30 wt. % to ≤70 wt. %, wherein in particular, the slippage of the carrier board can be improved by means of the filler materials, in particular by means of the chalk. Said filler materials may also be pigmented in a known manner. In particular, it may be provided that the material of the carrier boards has a flame retardant.

In a particularly preferred refinement of the invention, the material of the carrier board is composed of a mixture of a PE/PP block copolymer with wood. Here, the fraction of the PE/PP block copolymer and the fraction of the wood may lie between ≥45 wt. % and ≤55 wt. %. Furthermore, the material of the carrier board may have further additives, for example flow additives, thermal stabilizers or UV stabilizers, in a fraction between ≥0 wt. % and ≤10 wt. %. Here, the particle size of the wood lies between >0 μm and ≤600 μm, with a preferred particle size distribution D50 of ≥400 μm. In particular, the material of the carrier board may in this case have wood with a particle size distribution D10 of ≥400 μm. The particle size distribution is in this case in relation to the volumetric diameter, and relates to the volume of the particles. Here, the material of the carrier board is particularly preferably provided as a granulated or pelleted, pre-extruded mixture of a PE/PP block copolymer with wood particles in the stated particle size distribution. The granulate and/or the pellets may in this case preferably have approximately a grain size in a range from ≥400 μm to ≤10 mm, preferably ≥600 μm to ≤10 mm, in particular ≥800 μm to ≤10 mm.

In a further preferred refinement of the invention, the carrier board is composed of a mixture of a PE/PP polymer blend with wood. Here, the fraction of the PE/PP polymer blend and the fraction of the wood may lie between ≥45 wt. % and ≤55 wt. %. Furthermore, the material of the carrier board may have further additives, for example flow additives, thermal stabilizers or UV stabilizers, in a fraction between ≤0 wt. % and ≤10 wt. %. Here, the particle size of the wood lies between >0 μm and ≤600 μm, with a preferred particle size distribution D50 of ≥400 μm. In particular, the carrier board may have wood with a particle size distribution D10 of ≥400 μm. The particle size distribution is in this case in relation to the volumetric diameter, and relates to the volume of the particles. Here, the material of the carrier board is particularly preferably provided as a granulated or pelleted, pre-extruded mixture of a PE/PP polymer blend with wood particles in the stated particle size distribution. The granulate and/or the pellets may in this case preferably have approximately a grain size in a range from ≥400 μm to ≤10 mm, preferably ≥600 μm to ≤10 mm, in particular ≥800 μm to ≤10 mm.

In a further refinement of the invention, the material of the carrier board is composed of a mixture of a PP homopolymer with wood. Here, the fraction of the PP homopolymer and the fraction of the wood may lie between ≥45 wt. % and ≤55 wt. %. Furthermore, the material of the carrier board may have further additives, for example flow additives, thermal stabilizers or UV stabilizers, in a fraction between ≥0 wt. % and ≤10 wt. %. Here, the particle size of the wood lies between ≥0 μm and ≤600 μm, with a preferred particle size distribution D50 of ≥400 μm. In particular, the carrier board may in this case have wood with a particle size distribution D10 of ≥400 μm. The particle size distribution is in this case in relation to the volumetric diameter, and relates to the volume of the particles. Here, the material of the carrier board is particularly preferably provided as a granulated or pelleted, pre-extruded mixture of a PP homopolymer with wood particles in the stated particle size distribution. The granulate and/or the pellets may in this case preferably have approximately a grain size in a range from ≥400 μm to ≤10 mm, preferably ≥600 μm to ≤10 mm, in particular ≥800 μm to ≤10 mm. In a further refinement of the invention, the material of the carrier board is composed of a mixture of a PVC polymer with chalk. Here, the fraction of the PVC polymer and the chalk fraction may lie between ≥45 wt. % and ≤55 wt. %. Furthermore, the material of the carrier board may have further additives, for example flow additives, thermal stabilizers or UV stabilizers, in a fraction between ≥0 wt. % and ≤10 wt. %. Here, the particle size of the chalk lies between ≥0 μm and ≤600 μm, with a preferred particle size distribution D50 of ≥400 μm. In particular, the material of the carrier board may in this case have chalk with a particle size distribution D10 of ≥400 μm. The particle size distribution is in this case in relation to the volumetric diameter, and relates to the volume of the particles. Here, the material of the carrier board is particularly preferably provided as a granulated or pelleted, pre-extruded mixture of a PVC polymer with chalk in the stated particle size distribution. The granulate and/or the pellets may in this case preferably have approximately a grain size in a range from ≥400 μm to ≤10 mm, preferably ≥600 μm to ≤10 mm, in particular ≥800 μm to ≤10 mm.

In a further refinement of the invention, the material of the carrier board is composed of a mixture of a PVC polymer with wood. Here, the fraction of the PVC polymer and the wood fraction may lie between ≥45 wt. % and ≤55 wt. %. Furthermore, the material of the carrier board may have further additives, for example flow additives, thermal stabilizers or UV stabilizers, in a fraction between ≥0 wt. % and ≤10 wt. %. Here, the particle size of the wood lies between >0 μm and ≤600 μm, with a preferred particle size distribution D50 of ≥400 μm. In particular, the material of the carrier board may have wood with a particle size distribution D10 of ≤400 μm. The particle size distribution is in this case in relation to the volumetric diameter, and relates to the volume of the particles. Here, the material of the carrier board is particularly preferably provided as a granulated or pelleted, pre-extruded mixture of a PVC polymer with wood particles in the stated particle size distribution. The granulate and/or the pellets may in this case preferably have approximately a grain size in a range from ≥400 μm to ≤10 mm, preferably ≥600 μm to ≤10 mm, in particular ≥800 μm to ≤10 mm.

To determine the particle size distribution, use may be made of the generally known methods such as for example laser diffractometry; using these methods, it is possible to determine particle sizes in the range from a few nanometers up to several millimeters. It is thus also possible to determine D50 and D10 values, which 50% and 10% of the measured particles respectively are smaller than the specified value.

In a further refinement of the invention, the material of the carrier board has a matrix material, which has a plastic, and a solids material, wherein the solids material is formed in a fraction of at least 50 wt. %, in particular at least 80 wt. %, particularly preferably at least 95 wt. %, in relation to the solids material, by talc. Here, the matrix material is present in an amount, in relation to the material of the carrier, of ≥30 wt. % to ≤70 wt. %, in particular of ≥40 wt. % to ≤60 wt. %, and the solids material, in relation to the material of the carrier, is present in an amount, in relation to the material of the carrier board, of ≥30 wt. % to ≤70 wt. %, in particular of ≥40 wt. % to ≤60 wt. %, for example less than or equal to 50 wt. %. It is furthermore provided that the material of the carrier board and the solids material are together present in an amount, in relation to the material of the carrier board, of ≥95 wt. %, in particular ≥99 wt. %.

In such a refinement of the invention, the solids material may be formed in a fraction of at least 50 wt. %, in particular at least 80 wt. %, for example 100%, in relation to the solids material, by talc. Here, talc is to be understood, in a known manner, to mean a magnesium silicate hydrate, which may for example have the chemical molecular formula Mg3 [Si4O10(OH)2]. Thus, the solids fraction is advantageously formed at least to a major extent from the mineral substance talc, wherein said substance may be used for example in powder form or may be present in the material of the carrier board in the form of particles. The solids material may basically be composed of a solid in powder form.

It may be advantageous if the specific surface density in accordance with BET, ISO 4652 of the talc particles lies in a range from ≥4 m2/g to ≤8 m2/g, for example in a range from ≥5 m2/g to ≤7 m2/g.

It may furthermore be advantageous if the talc is present in a bulk density in accordance with DIN 53468 in a range from ≥0.15 g/cm3 to ≤0.45 g/cm3, for example in a range from ≥0.25 g/cm3 to ≤0.35 g/cm3.

In such a refinement of the invention, the matrix material serves in particular for the absorbing or embedding of the solids material in the fully produced carrier. Here, the matrix material has a plastic or a plastics mixture. In particular with regard to the production method, as is described in detail below, it may be advantageous for the matrix material to have a thermoplastic material. It is made possible in this way for the material of the carrier board or a constituent of the material of the carrier board to have a melting point or a softening point in order for the material of the carrier board to be molded, in a further method step, under the action of heat, as will be described in detail below with regard to the method. The matrix material may in particular be composed of a plastic or a plastics mixture and possibly an adhesion promoter. Said components may preferably make up at least 90 wt. %, particularly preferably at least 95 wt. %, in particular at least 99 wt. % of the matrix material.

It may furthermore be provided that the matrix material is present in an amount, in relation to the material of the carrier board, from ≥30 wt. % to ≤70 wt. %, in particular from ≥40 wt. % to ≤60 wt. %. It is furthermore provided that the solids material, in relation to the material of the carrier board, is present in an amount, in relation to the material of the carrier board, from ≥30 wt. % to ≤70 wt. %, in particular from ≥40 wt. % to ≤60 wt. %.

Polypropylene is particularly suitable as matrix material because it is firstly available at low cost and, furthermore, as a thermoplastic material, it has good characteristics as a matrix material for the embedding of the solids material. Here, in particular, a mixture of a homopolymer and of a copolymer may permit particularly advantageous characteristics for the matrix material. Such materials also offer the advantage that they can be molded, in the above-described method, to form a carrier even at low temperatures, for example in a range from ≥180° C. to ≤200° C., such that particularly effective process management, for example with exemplary line speeds in the region of 6 m/min, can be made possible.

Furthermore, it may be advantageous if the homopolymer has a tensile strength in accordance with ISO 527-2 which lies in a range from ≥30 MPa to ≤45 MPa, for example in a range from ≥35 MPa to ≤40 MPa, in order to achieve good stability.

Furthermore, in particular for good stability, it may be advantageous if the homopolymer has a flexural modulus in accordance with ISO 178 in a range from ≥1000 MPa to ≤2200 MPa, for example in a range from ≥1300 MPa to ≤1900 MPa, for example in a range from ≥1500 MPa to ≤1700 MPa.

With regard to the tensile deformation of the homopolymer in accordance with ISO 527-2, it may furthermore be advantageous if said tensile deformation lies in a range from ≥5% to ≤13%, for example in a range from ≥8% to ≤10%.

For particularly advantageous producibility, it may be provided that the Vicat softening temperature in accordance with ISO 306/A for an injection-molded component lies in a range from ≥130° C. to ≤170° C., for example in a range from ≥145° C. to ≤158° C.

It may furthermore advantageously be provided that the solids material has at least one further solid in addition to talc. This refinement may make it possible in particular for the weight of the material of the carrier board or of a panel formed using the material of the carrier board to be considerably reduced in relation to a material of the carrier board or panel in which the solids material is composed of talc. It is thus possible for the solid added to the solids material to have a reduced density in particular in relation to talc. For example, the added substance may have a raw density which lies in a range of ≤2000 kg/m3, in particular of ≤1500 kg/m3, for example of ≤1000 kg/m3, particularly preferably of ≤500 kg/m3. Depending on the solid used, it is furthermore possible here for further adaptability to the desired, in particular mechanical characteristics to be made possible.

For example, the further solid may be selected from the group comprising wood, for example in the form of wood powder, expanded clay, volcanic ash, pumice, porous concrete, in particular inorganic foams, cellulose. With regard to porous concrete, this may for example be the solid used by the company Xella under the trade name YTONG, which is composed substantially of quartz sand, limestone and cement, or the porous concrete may have the abovementioned constituents. With regard to the added solid, said solid may for example be constructed from particles which have the same particle size and/or particle size distribution as the particle sizes and/or particle size distributions described above for talc. The further solids may in particular be present in the solids material in a fraction which lies in a range of <50 wt. %, in particular <20 wt. %, for example <10 wt. %, furthermore for example <5 wt. %.

Alternatively, for example for wood, in particular for wood powder, it may be provided that the particle size thereof lies between ≥0 μm and ≤600 μm, with a preferred particle size distribution D50 of ≥400 μm.

In a further refinement, the material of the carrier plate may have hollow microspheres. Such additives may have the effect in particular that the density of the carrier board and thus of the produced panel can be significantly reduced, such that particularly easy and inexpensive transport, and furthermore particularly convenient installation, can be ensured. Here, in particular as a result of the incorporation of hollow microspheres, it is possible to ensure a stability of the produced panel which is not significantly reduced in relation to a material without hollow microspheres. Thus, the stability is entirely adequate for a majority of applications. Here, hollow microspheres may be understood in particular to mean structures which have a hollow main body and which have a size or a maximum diameter which lies in the micrometer range. For example, hollow spheres that can be used may have a diameter which lies in the range from ≥5 μm to ≤100 μm, for example ≥20 μm to ≤50 μm. As material for the hollow microspheres, use may basically be made of any material, such as for example glass or ceramic. Furthermore, owing to the weight, plastics, for example the plastics also used in the material of the carrier board, for example PVC, PE or PP, may be advantageous, wherein these may possibly, for example by means of suitable additives, be prevented from deforming during the production process.

The hardness of the material of the carrier board may assume values in a range from 30-90 N/mm$^2$ (measured in accordance with Brinell). The modulus of elasticity may lie in a range from 3000 to 7000 N/mm$^2$.

The partial section of the groove base of the arresting groove and the partial section of the top side of the receiving edge may be oriented parallel to one another in the locked state.

The receiving groove of one hook profile is realized such that the arresting edge of the complementary hook profile fits into the receiving groove, and the arresting groove of the complementary hook profile is realized such that the receiving edge of the former hook profile fits into the arresting groove.

A refinement provides that the first detent means of the lower detent engagement point has a detent projection, and the second detent means of the lower detent engagement point has a detent depression adapted to said detent projection.

Alternatively, the first detent means of the lower detent engagement point may have a detent depression, and the second detent means of the lower detent engagement point may have a detent projection adapted to said detent depression.

It may furthermore be expedient if an upper detent engagement point is provided which has a first detent means on an outer side of the arresting edge, and a second detent means corresponding to said first detent means is provided on a recessed groove flank of the receiving groove.

It is expedient if the first detent means of the upper detent engagement point has a detent projection, and the second detent means of the upper detent engagement point has a detent depression adapted to said detent projection.

Alternatively, the first detent means of the upper detent engagement point may have a detent depression, and the second detent means of the upper detent engagement point may have a detent projection adapted to said detent depression.

A further benefit is obtained if at least one free space is provided between the underside of the arresting edge and the groove base of the receiving groove. The free space can collect dirt particles or other loose particles. In the case of panels composed of wood materials, it is for example possible for particles to become detached from the panel margin, which particles must not become stuck between joining surfaces of the hook profiles. Such particles could otherwise impede correctly positioned locking of the hook profiles.

It is furthermore expedient if, in the locked state, a gap is provided between outer side of the receiving edge and groove flank of the arresting groove.

It is expediently the case that an underside of the arresting edge makes contact at least in regions with the groove base of the receiving groove in the locked state. If a load acts on the panel top side in the region of the arresting edge, the arresting edge can bear said load because its underside is supported on the groove base of the receiving groove of the receiving hook.

The receiving edge expediently has a transition to the inner side of the receiving groove, wherein the transition is provided with a curvature. The curvature offers margin protection. Said curvature can furthermore serve for guiding the arresting edge when the latter comes into contact with the curvature. Thus, the arresting edge is moved downward along the curvature into the receiving groove.

BRIEF DESCRIPTION OF THE DRAWINGS

Below, the invention will be illustrated by way of example in a drawing, and will be described in detail on the basis of several exemplary embodiments. In the drawing:

FIG. 5*a* shows an enlarged detail as per excerpt Va in FIG. 5, FIG. 5*b* shows an alternative for FIG. 5*a*, FIG. 8*a* shows an enlarged detail as per detail VIIIa in FIG. 8, FIG. 8*b* shows an alternative for FIG. 8*a*.

DETAILED DESCRIPTION OF THE INVENTION

Figure 1:
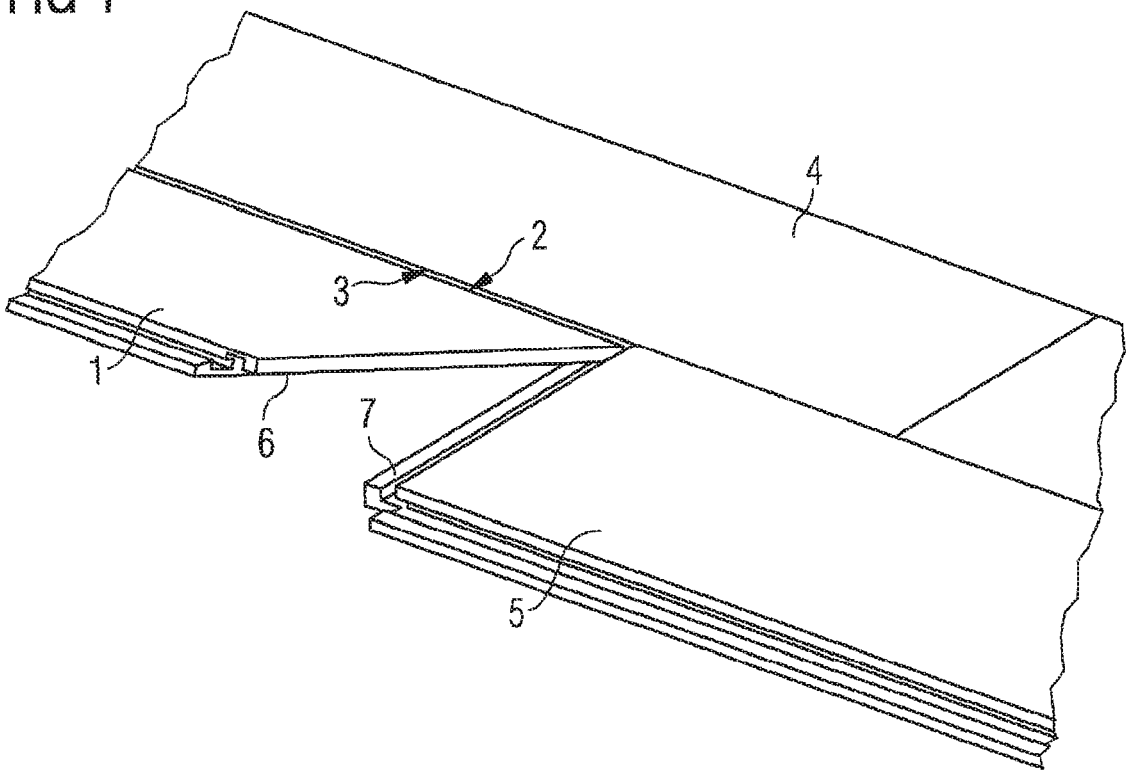
FIG. 1 shows a fold-down method in a right-handed configuration.

FIG. 1 shows, in a perspective view, a fold-down method for the locking of panels as per the prior art. Here, a new panel 1 is set at an oblique angle, and is placed, with a tongue profile margin 2 to the fore, onto a groove profile margin 3 of a laid panel 4 of a preceding panel row. Subsequently, the new panel 1 is pivoted down into the plane of the installed panels, wherein an identical panel 5 has already been laid in the same panel row. By means of the pivoting joining movement, the tongue and groove profile margins lock together. The new panel 1 furthermore has a pair of hook profiles, specifically a receiving hook (not illustrated) and an arresting hook 6. During the downward pivoting joining movement, the arresting hook 6 of the new panel 1 moves in the direction of the complementary receiving hook 7 of the identical panel 5 with a scissor-like movement. Here, the arresting hook 6 hooks together with the receiving hook 7 and form-fitting locking of the hook profiles occurs at the same time as the locking of the tongue and groove profile margins.

The structure of a floor surface is indicated in FIG. 1. In this example, a new panel is always laid toward the left in continuous fashion.

Figure 2:
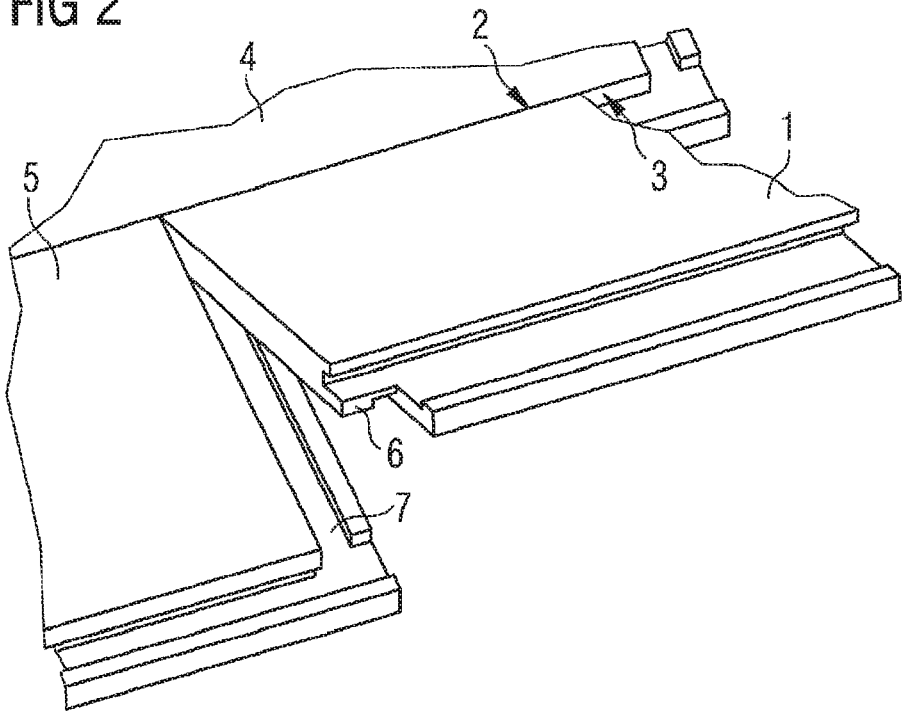
FIG. 2 shows a fold-down method in a left-handed configuration.

FIG. 2 shows a second example of a fold-down method, known from the prior art, for the locking of panels. Said second example differs from the method of FIG. 1 merely in that a new panel must be laid toward the right in continuous fashion, that is to say the panel margins which have the receiving hooks and the arresting hooks respectively have been interchanged in relation to the example of FIG. 1.

Groove and tongue profiles that are suitable for form-fitting locking by means of the fold-down method are well known from the prior art, for example from WO 97/47834 A1 or from WO 00/63510.

Figure 3:
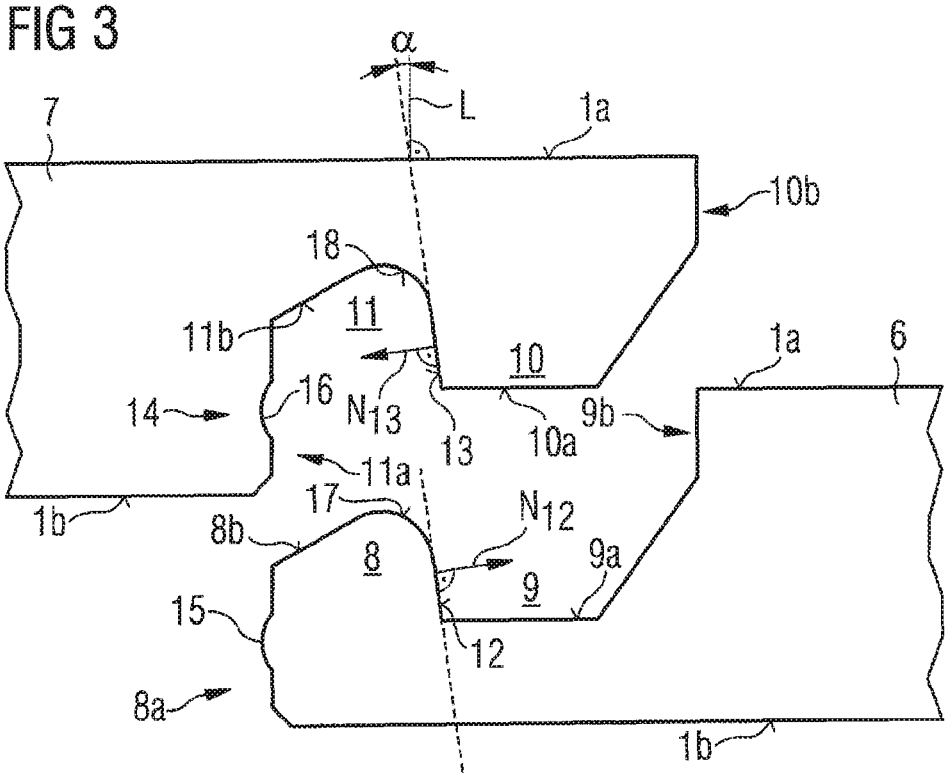
FIG. 3 shows a first exemplary embodiment of a panel according to the invention, wherein the panel is illustrated in divided form in order to illustrate its oppositely situated hook profiles in the still-unlocked state.

FIG. 3 illustrates a first exemplary embodiment of a panel 1 according to the invention, having a panel top side 1*a* and a panel underside 1*b*, wherein, in simplified form, only one holding profile pair of the panel is illustrated. The holding profile pair shown here has complementary hook profiles, specifically an arresting hook 6 (top) and a receiving hook 7 (bottom). To explain the mode of operation the panel 1 may be considered as having been divided into two parts, such that the two hook profiles (6 and 7) of the panel can be hooked together. Hook profiles of identical panels are self-evidently locked in the same way.

The receiving hook 6 has a receiving edge 8 directed toward the panel top side 1*a* and a receiving groove 9 which is open toward the panel top side. The arresting hook 7 is equipped with an arresting edge 10, which is directed toward the panel underside 1*b*, and with an arresting groove 11, which is open toward the panel underside 1*b*.

An inner side of the receiving edge 8 faces toward the receiving groove 9, and said inner side serves as lower locking surface 12. In a manner adapted to this, the arresting hook 7, on an inner side, facing toward the arresting groove 11, of its arresting edge 10, forms an upper locking surface 13 which interacts with the lower locking surface 12 of the receiving edge 8.

Both the lower locking surface 12 and the upper locking surface 13 are each inclined relative to the perpendicular L to the panel top side by an angle α. The inclinations are matched to one another such that the corresponding locking surfaces 12 and 13, in the locked state, are oriented parallel to one another and can make contact.

Furthermore, the inclination of the lower locking surface 12 is selected such that the normal vector $N_{12}$, which is directed perpendicularly outward from the lower locking surface 12, intersects the panel top side 1*a*. It is correspondingly conversely the case that the normal vector $N_{13}$ is directed perpendicularly outward from the upper locking surface 13, such that said normal vector $N_{13}$ intersects the oppositely situated panel underside 1*b*. In general, it is the case that the panel top side 1*a* and the normal vector $N_{12}$ enclose an angle which is of the same magnitude as the angle α mentioned above (alternate angles). The same applies to the panel underside, which encloses an equal angle (alternate angle) with the normal vector $N_{13}$.

By means of an underside 10*a* of the arresting edge 10, the arresting hook 7 is seated firmly on a groove base 9*a* of the receiving groove 9 of the receiving hook 6. If a load presses against the panel top side 1*a* in the region of the arresting edge 10, the arresting edge 10 can bear said load, because the underside 10*a* of said arresting edge is supported on the groove base 9*a* of the receiving groove 9.

A further function of the hook profiles is that of counteracting a height offset of the locked panel margins. For this purpose, a lower detent engagement point 14 is provided. Said lower detent engagement point comprises a first detent means, in the form of a protruding detent projection 15, on the receiving hook 7. The detent projection 15 is arranged on an outer side 8*a* of the receiving edge 8. Correspondingly to this, a second detent means in the form of a detent depression 16 is provided on the arresting hook 7. The detent depression 16 is arranged on a recessed groove flank 11*a* of the arresting groove 11.

On the receiving hook 6, a partial section 8*b* of the top side of the receiving edge 8 is inclined downward, specifically in downward-sloping fashion in the direction of the outer side 8*a* of the receiving edge. In a manner adapted to this, on the arresting hook 7, a partial section 11*b* of the groove base of the arresting groove 11 is adapted in complementary fashion to the inclination of the partial section 8*b* of the top side of the receiving edge 8. In the locked state, the inclined partial sections 8*b* and 11*b* of receiving edge top side and arresting groove base are oriented parallel to one another.

Furthermore, on the receiving hook 6, a transition is provided from the top side 8*b* of the receiving edge 8 to the lower locking surface 12. The transition is formed as a curvature 17. In the present example, the curvature 17 is a radius. Likewise, on the arresting hook 7, a transition with a curvature 18 is provided between the partial section 11*b* of the groove base of the arresting groove 11 and the upper locking surface 13. The curvature 17 at the receiving edge offers margin protection and a guide surface. The margin protection is more intense than the protective action of a bevel which has the same width and height as the curvature 17. The curvature 18 forms a hollow. In the present example, it has a radius and serves for stability in the transition region from the upper locking surface 13 to the groove base of the arresting groove 11.

Figure 4:
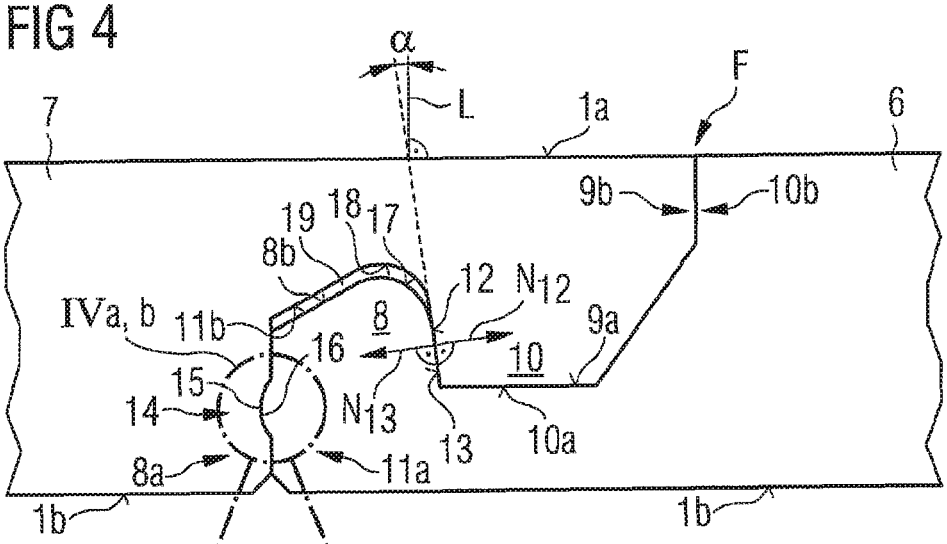
FIG. 4 shows the hook profiles of the panel as per FIG. 3 in the locked state.

FIG. 4 shows the hook profiles from FIG. 3 in the locked state. The detent projection 15 of the receiving hook 6, which is arranged on the outer side 8*a* of the receiving edge 8, engages with a form fit into the detent depression 16, which is arranged on the recessed groove flank 11*a* of the arresting groove 11. The lower detent engagement point 14 counteracts a height offset of the two panel top sides 1*a*, that is to say a movement of the panel margins apart perpendicular to the panel surface is counteracted. On the panel surface 1*a*, a closed interstice F is also formed in the horizontal direction. At said interstice, an outer side 10*b* of the arresting edge 10 is in contact with a recessed groove flank 9*b* of the receiving groove 9.

A gap 19 is provided between the inclined partial section 11*b* of the groove base of the arresting groove and the inclined partial section 8*b* of the top side of the receiving edge 8. Said gap favors the avoidance of a height offset at the interstice F of the panel top side 1*a*. Furthermore, the gap 19 ensures a certain flexibility of the arresting hook 7. Said arresting hook 7 has a point with its smallest thickness, said point being situated where the arresting groove 11 is at its deepest. The flexibility thus obtained can be utilized because the gap 19 creates space into which a deformation can take place.

Figure 4A:
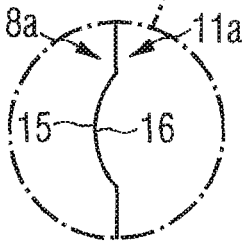
FIG. 4*a* shows an enlarged detail as per excerpt IVa in FIG. 4.

FIG. 4*a* shows, in a detail, an enlarged excerpt which is indicated in FIG. 4 by IVa. In FIG. 4*a*, the detent projection 15 is provided on the receiving hook 6, specifically on the outer side 8*a* of the receiving edge 8. The detent depression is provided on the arresting hook 7, and there, on a recessed groove flank 11*a* of the arresting groove 11.

Figure 4B:
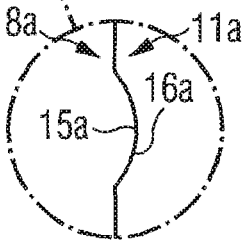
FIG. 4*b* shows an alternative for FIG. 4*a*.

In an alternative which is shown in the excerpt as per FIG. 4*b*, the positions of detent depression and detent projection have been interchanged. Here, a detent depression 15*a* is arranged on the receiving hook 6, specifically on the outer side 8*a* of the receiving edge 8. A detent projection 16*a* is then provided on the arresting hook 7, specifically on its recessed groove flank 11*a* of the arresting groove 11.

Figure 5:
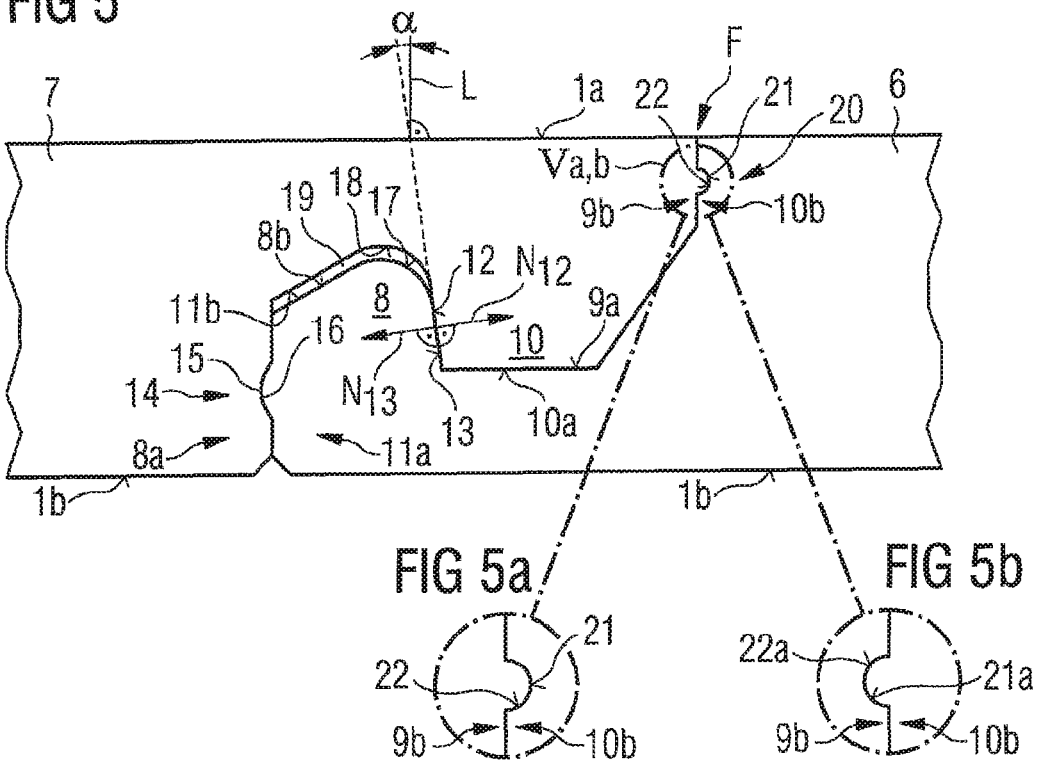
FIG. 5 shows a further exemplary embodiment for hook profiles of the panel as per FIG. 3 in the locked state.

A further exemplary embodiment for a panel with special hook profiles is proposed in FIG. 5. The latter is based on the exemplary embodiment of FIGS. 3 and 4. It differs from said exemplary embodiment by an additional, upper detent engagement point 20.

The upper detent engagement point 20 has, on the arresting hook 7, a first detent means in the form of a detent projection 21, which is arranged on the outer side 10*b* of the arresting edge 10. Said detent projection interacts with a second detent means, corresponding thereto, on the receiving hook 6, which second detent means is provided on the recessed groove flank 9*b* of the receiving groove 9. The second detent means forms a detent depression 22, as can be seen most clearly in the excerpt as per FIG. 5*a*. FIG. 5*a* shows, on an enlarged scale, the detail indicated in FIG. 5 by Va.

In an alternative which is shown in the excerpt as per FIG. 5*b*, the positions of detent depression and detent projection have been interchanged. Here, a detent depression 21*a* is arranged on the arresting hook, specifically on the outer side of the arresting edge 10. A detent projection 22*a* is provided on the receiving hook, specifically on the recessed groove flank 9*b* of the receiving groove 9.

Figure 6:
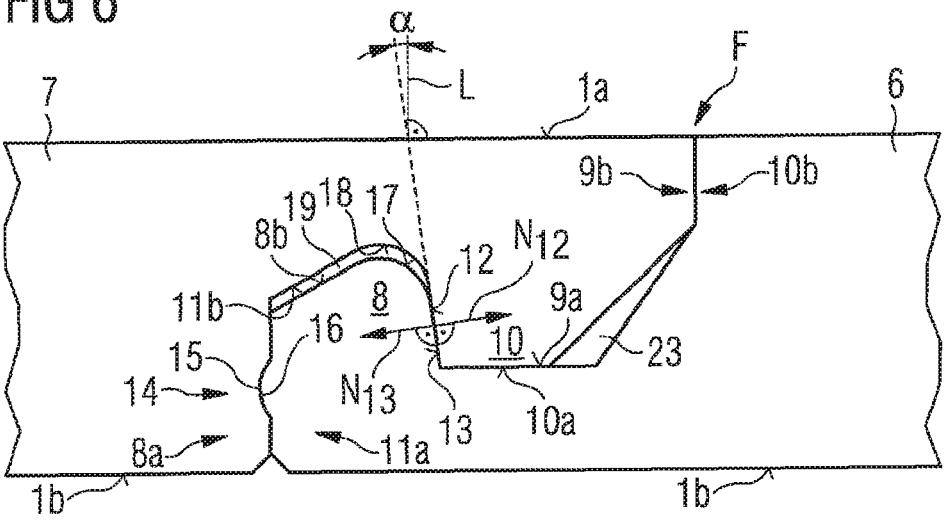
FIG. 6 shows a further exemplary embodiment for hook profiles of the panel as per FIG. 3 in the locked state.

The exemplary embodiment of FIG. 6 shows hook profiles which have a modification proceeding from FIGS. 3 and 4; specifically, in the illustrated locked state of the hook profiles, a free space 23 is formed which extends between the groove base 9*a* of the receiving groove 9 of the receiving hook 6 and an underside 10*a* of the arresting edge 10 of the arresting hook 7. The free space 23 extends as far as the outer side 10*b* of the arresting edge 10 or as far as the recessed groove flank 9*b* of the receiving groove 9. The free space 23 can accommodate dirt particles or other loose particles. In the case of panels composed of wood materials, it is for example possible for particles to become detached from the panel margin. Detached particles must not pass between the joining surfaces of the hook profiles and become stuck there, because they otherwise impede correctly positioned locking of the hook profiles. The free space 23 proposed in FIG. 6 is formed in the manner of a gap between the under side 10*a* of the arresting edge 10 and the groove base 9*a* of the receiving groove 9. The gap-like free space 23 becomes wider toward the groove base 9*a* and thereby creates the desired space for accommodating undesired particles.

Figure 7:
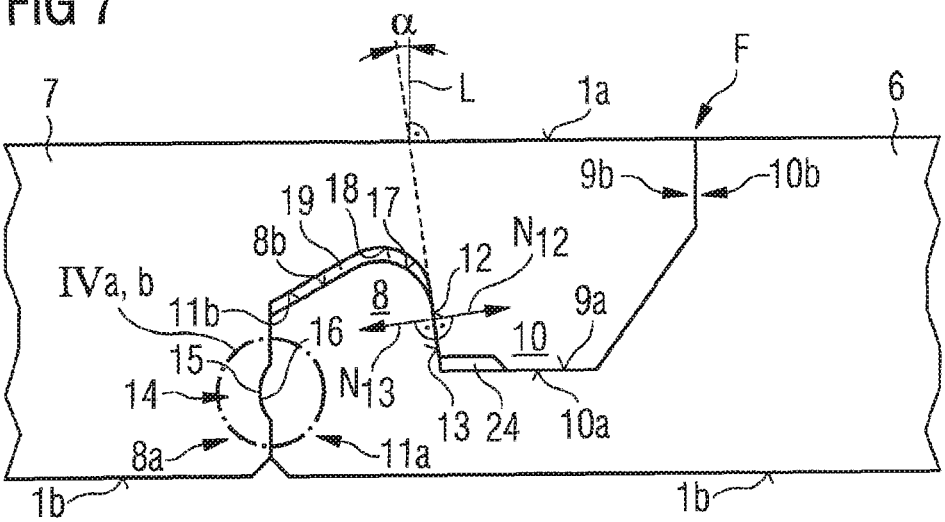
FIG. 7 shows a further exemplary embodiment for hook profiles of the panel as per FIG. 3 in the locked state.

The exemplary embodiment of FIG. 7 shows hook profiles which likewise have a modification proceeding from FIGS. 3 and 4, specifically such that, again, in the locked state of the hook profiles, a free space 24 is formed which extends between the groove base 9*a* of the receiving groove 9 of the receiving hook 6 and an underside 10*a* of the arresting edge 10 of the arresting hook 7. The free space 24 extends as far as the lower locking surface 12 of the receiving hook 6 or as far as the upper locking surface 13 of the arresting hook 7. To realize the free space 24, the underside 10*a* of the arresting edge 10 is equipped with a shallow shoulder 24*a* which is set back from the underside 10*a* of the arresting edge 10. The free space 24 can likewise accommodate dirt particles or other loose particles and, in the case of panels composed of wood materials, accommodate any detached wood particles that would otherwise become stuck between the joining surfaces of the hook profiles and impede correctly positioned locking of the hook profiles. The remaining region of the underside 10*a* is, in the locked state, in contact with the groove base 9*a* of the receiving groove 9 and thereby supported.

Figure 8:
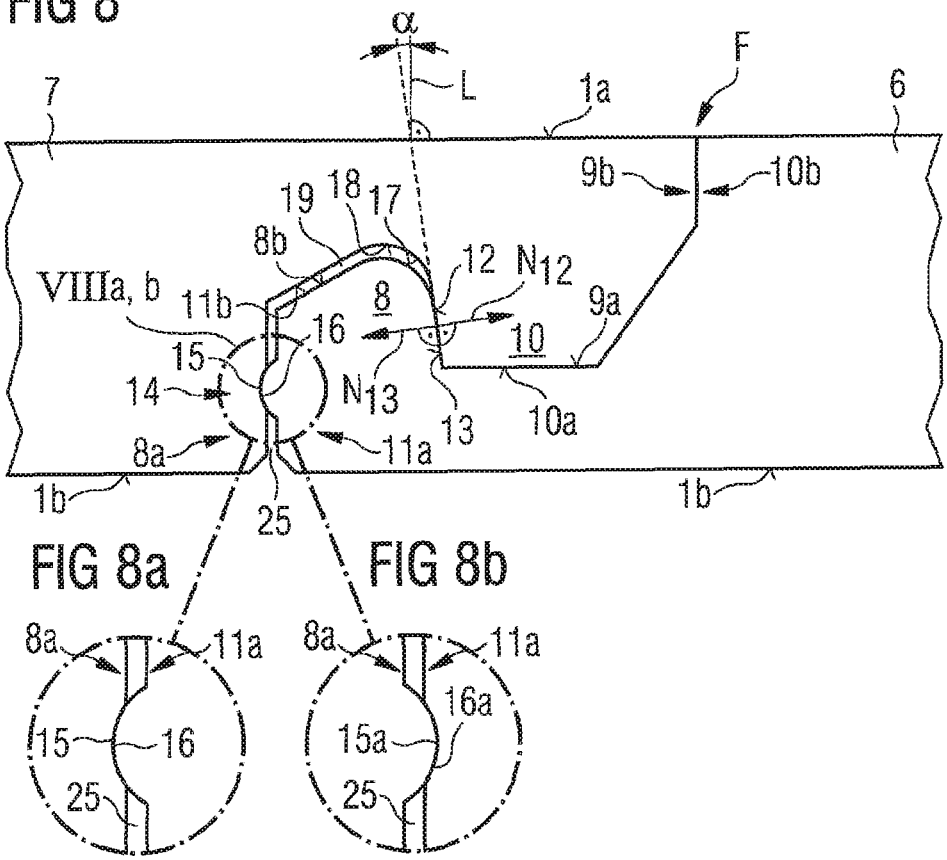
FIG. 8 shows a further exemplary embodiment for hook profiles of the panel as per FIG. 3 in the locked state.

The exemplary embodiment of FIG. 8 likewise shows hook profiles which proceed from FIGS. 3 and 4. In relation to said figures, only the lower detent engagement point 14 has been modified. In FIG. 8, the detent projection 15 of the receiving hook 6 protrudes further from the outer side 8*a* of the receiving edge 8 than in FIG. 4. The depth of the detent depression 16 is unchanged in relation to FIG. 4. As a result, a gap 25 is formed between the outer side 8*a* and the recessed groove flank 11*a* of the arresting groove 11 of the arresting hook 7. The gap 25 improves the detent engagement capability of the lower detent engagement point 14.

FIG. 8*a* shows the lower detent engagement point 14 as an enlarged excerpt. An alternative to FIG. 8*a* is shown in the excerpt as per FIG. 8*b*. In the latter, the positions of detent depression and detent projection have been interchanged. A detent depression 15*a* is now arranged on the receiving hook 6, specifically on the outer side 8*a* of the receiving edge 8. For this purpose, a detent projection 16*a* is provided on the arresting hook 7 on its recessed groove flank 11*a* of the arresting groove 11.

Figure 9:
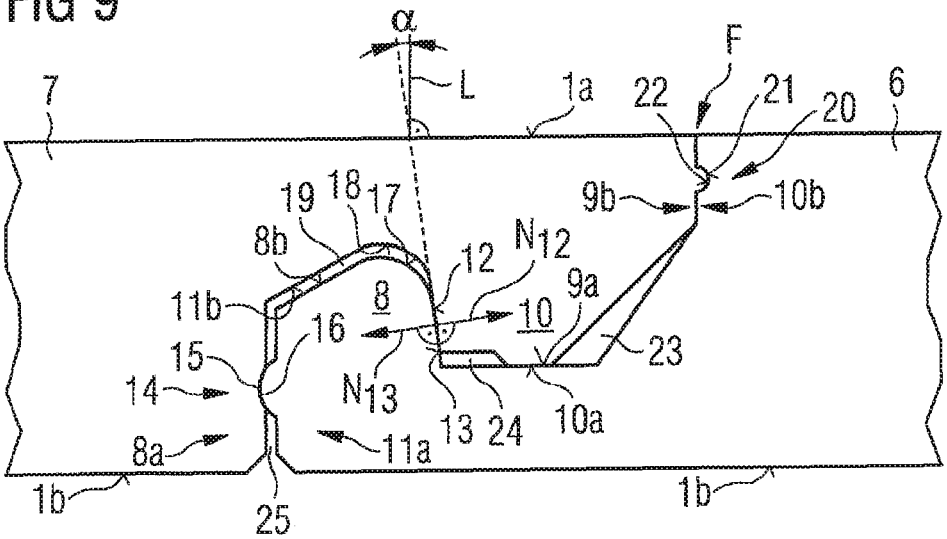
FIG. 9 shows a further exemplary embodiment for hook profiles of the panel as per FIG. 3 in the locked state.

A further exemplary embodiment for hook profiles of the panel is illustrated in FIG. 9. This, too, is based on FIGS. 3 and 4 and furthermore integrates all modifications that have been proposed in the examples of FIG. 5, FIG. 6, FIG. 7 and FIG. 8.

LIST OF REFERENCE DESIGNATIONS

1 New panel
1*a* Panel top side
1*b* Panel underside
2 Tongue profile margin
3 Groove profile margin
4 Laid panel of preceding row
5 Panel of the same panel row
6 Receiving hook
7 Arresting hook
8 Receiving edge
8*a* Outer side
8*b* Partial section, top side
9 Receiving groove
9*a* Groove base
9*b* Recessed groove flank
10 Arresting edge
10*a* Underside
10*b* Outer side
11 Arresting groove
11*a* Recessed groove flank
11*b* Partial section, groove base
12 Lower locking surface
13 Upper locking surface
14 Lower detent engagement point
15 Detent projection
15*a* Detent depression
16 Detent depression
16*a* Detent projection
17 Curvature
18 Curvature
19 Gap
20 Upper detent engagement point
21 Detent projection
21*a* Detent depression
22 Detent depression
22*a* Detent projection
23 Free space
24 Free space
25 Gap
α Angle
F Interstice

What is claimed is:

1. A panel comprising a panel top side and a panel underside and comprising at least four panel margins which are situated opposite one another in pairwise fashion, having complementary holding profiles which are provided in pairwise fashion on the panel margins and which fit together such that identical panels are fastenable to one another, wherein at least one of the holding profile pairs is equipped with hook profiles, specifically with a receiving hook on one panel margin and with an arresting hook on the opposite panel margin, wherein the receiving hook has a receiving edge directed toward the panel top side and a receiving groove open toward the panel top side, and the arresting hook is equipped with an arresting edge which is directed toward the panel underside and with an arresting groove which is open toward the panel underside, wherein the receiving edge has a receiving edge inner side which faces toward the receiving groove, and said receiving edge inner side serves as a lower locking surface, and in a similar manner, the arresting edge has an arresting edge inner side which faces toward the arresting groove, and said arresting edge inner side serves as a corresponding upper locking surface, with the structure that both the lower locking surface and the upper locking surface are each inclined relative to the perpendicular to the panel top side such that, in the locked state, said lower locking surface and upper locking surface are oriented parallel to one another and make contact, wherein the inclination of the locking surfaces is such that the normal vector with respect to the lower locking surface intersects the panel top side and the normal vector with respect to the upper locking surface intersects the panel underside, wherein a lower detent engagement point is provided which comprises a first detent means which is arranged on an outer side of the receiving edge, and the lower detent engagement point comprises a second detent means which corresponds to said first detent means and which is arranged on a recessed groove flank of the arresting groove, wherein at least a partial section of the top side of the receiving edge runs downward in an inclined manner in the direction of the outer side of the receiving edge, wherein at least a partial section of the groove base of the arresting groove is adapted in complementary fashion to the inclination of the partial section of the top side of the receiving edge, wherein, in a coupled condition, a gap is provided between the inclined partial section of the groove base of the arresting groove and the inclined partial section of the top side of the receiving edge, wherein the first detent means of the lower detent engagement point has a detent projection, and in that the second detent means of the lower detent engagement point has a detent depression adapted to said detent projection, wherein, in coupled condition, a lower gap is formed between the outer side of the receiving edge and the recessed groove flank of the arresting groove of the arresting hook, wherein said lower gap has an upper section having a substantially constant width and a connecting lower section having an increasing width in downward direction toward the panel underside, wherein a lower portion of the detent projection connects to said upper portion of said lower gap, wherein an upper gap is formed between the outer side of the receiving edge and the recessed groove flank of the arresting groove of the arresting hook, wherein the upper gap is positioned vertically above the first and second detent means and extends up to an upper side of the receiving hook, wherein the upper gap has a substantially constant width and extends in a vertical direction.

2. The panel according to claim 1, wherein the gap, provided between the inclined partial section of the groove base of the arresting groove and the inclined partial section of the top side of the receiving edge, has a decreasing width in downward direction toward the panel underside.

3. The panel according to claim 1, wherein a part of the upper section of the lower gap has an increasing width in downward direction toward the panel underside.

4. The panel according to claim 1, wherein a transition is provided between the partial section of the groove base of the arresting groove and the upper locking surface of the arresting hook, and wherein the transition is curved.

5. The panel according to claim 1, wherein an outer side of the arresting edge and a facing recessed groove flank of the receiving groove are free of any detent means.

6. The panel as claimed in claim 1, wherein at least one free space is provided between the underside of the arresting edge and the groove base of the receiving groove.

7. The panel as claimed in claim 1, wherein the underside of the arresting edge makes contact at least in regions with the groove base of the receiving groove in the locked state.

8. The panel as claimed in claim 1, wherein the material of the carrier board comprises a wood polymer material.

* * * * *